US006241553B1

(12) United States Patent
Hsia

(10) Patent No.: US 6,241,553 B1
(45) Date of Patent: Jun. 5, 2001

(54) CONNECTOR FOR ELECTRICAL CORDS AND CABLES

(76) Inventor: Yu-Chao Hsia, P.O. Box 82-144, Taipei (TW)

( * ) Notice: Subject to any disclaimer, the term of this patent is extended or adjusted under 35 U.S.C. 154(b) by 0 days.

(21) Appl. No.: 09/496,173

(22) Filed: Feb. 2, 2000

(51) Int. Cl.[7] ..... H01R 9/05
(52) U.S. Cl. ..... 439/578; 439/584
(58) Field of Search ..... 439/578, 579, 439/580, 581, 582, 583, 584, 585

(56) References Cited

U.S. PATENT DOCUMENTS

| | | | | |
|---|---|---|---|---|
| 4,973,265 | * | 11/1990 | Heeren | 439/584 |
| 5,002,503 | * | 3/1991 | Campbell et al. | 439/578 |
| 5,466,173 | * | 11/1995 | Down | 439/584 |
| 5,586,910 | * | 12/1996 | Negro et al. | 439/584 |
| 5,967,852 | * | 10/1999 | Follingstad et al. | 439/675 |

* cited by examiner

*Primary Examiner*—Khiem Nguyen
*Assistant Examiner*—Michael C. Zarroli
(74) *Attorney, Agent, or Firm*—A & J

(57) ABSTRACT

A connector for electrical cords and cables includes a tubular body, a plastic engaging sleeve, a connecting sleeve, a connecting plug and a metal ring. The tubular body has a longitudinal through hole formed with a stepped recess at an end thereof, a first hole at an intermediate portion thereof, and a second hole at another end thereof. The plastic engaging sleeve has a stepped outer surface and formed with a conical longitudinal hole with a smaller inner diameter at the larger end thereof. The connecting sleeve has a tubular hexagonal nut portion from an end of which extends a cylindrical portion and is formed with a through hole having a recess at the outer end of the tubular hexagonal nut portion for receiving an O-ring, a circular rib adjacent to the recess and internal threads extending from the circular rib to an outer end of the cylindrical portion. The connecting plug has a longitudinal through hole for passage of an electrical cord or cable. The metal ring has a central hole for passage of an electrical cord or cable and fitted on the larger end of the plastic engaging sleeve for protecting the plastic engaging sleeve from damage.

1 Claim, 5 Drawing Sheets

CONNECTOR FOR ELECTRICAL CORDS AND CABLES

BACKGROUND OF THE INVENTION

1. Field of the Invention

This invention is related to an improvement in the structure of a connector for electrical cords and cables.

2. Description of the Prior Art

As the conventional connector is connected with an electrical cord or cable, the electrical cord or cable will often be twisted, thereby making it unable to keep straight and therefore causing difficulty in connection.

The conventional electrical cord or cable simply uses a sleeve made of iron sheet to hold an electrical cord or cable, so that it cannot keep an electrical cord or cable firmly in position. Furthermore, the procedures for the engagement between the cable and such a conventional connector are troublesome. In addition, in the case of strong winds, the cable will disengage from the connector and water may also penetrate into the cable.

It is necessary to use pliers for the engagement of the cable and the conventional connector, but as the component fitted with a cable is made of plastic material so that it will be easily damaged or even broken when it is clamped by the pliers for engagement.

U.S. Pat. Nos. 5,769,662 and 5,066,248 suffer one or even many of the above-mentioned drawbacks. In brief, these patents do not use any means to protect the plastic component provided on the electric cable, so that the component will be easily damaged, deformed, or even broken when the component is engaged with the connector. Furthermore, the cable cannot be firmly clipped and will easily disengage from the connector. In addition, water will easily penetrate the cable.

Therefore, it is an object of the present invention to provide an improvement in the structure of a connector for electrical cords and cables which can obviate and mitigate the above-mentioned drawbacks.

SUMMARY OF THE INVENTION

This invention is related to an improvement in the structure of a connector for electrical cords and cables.

It is the primary object of the present invention to provide an improvement in the structure of a connector which will not twist a cord or cable when engaged therewith.

It is another object of the present invention to provide an improvement in the structure of a connector which can firmly engaged with an electrical cord or cable.

It is a further object of the present invention to provide an improvement in the structure of a connector for electrical cords and cables which can prevent water from penetrate therein.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
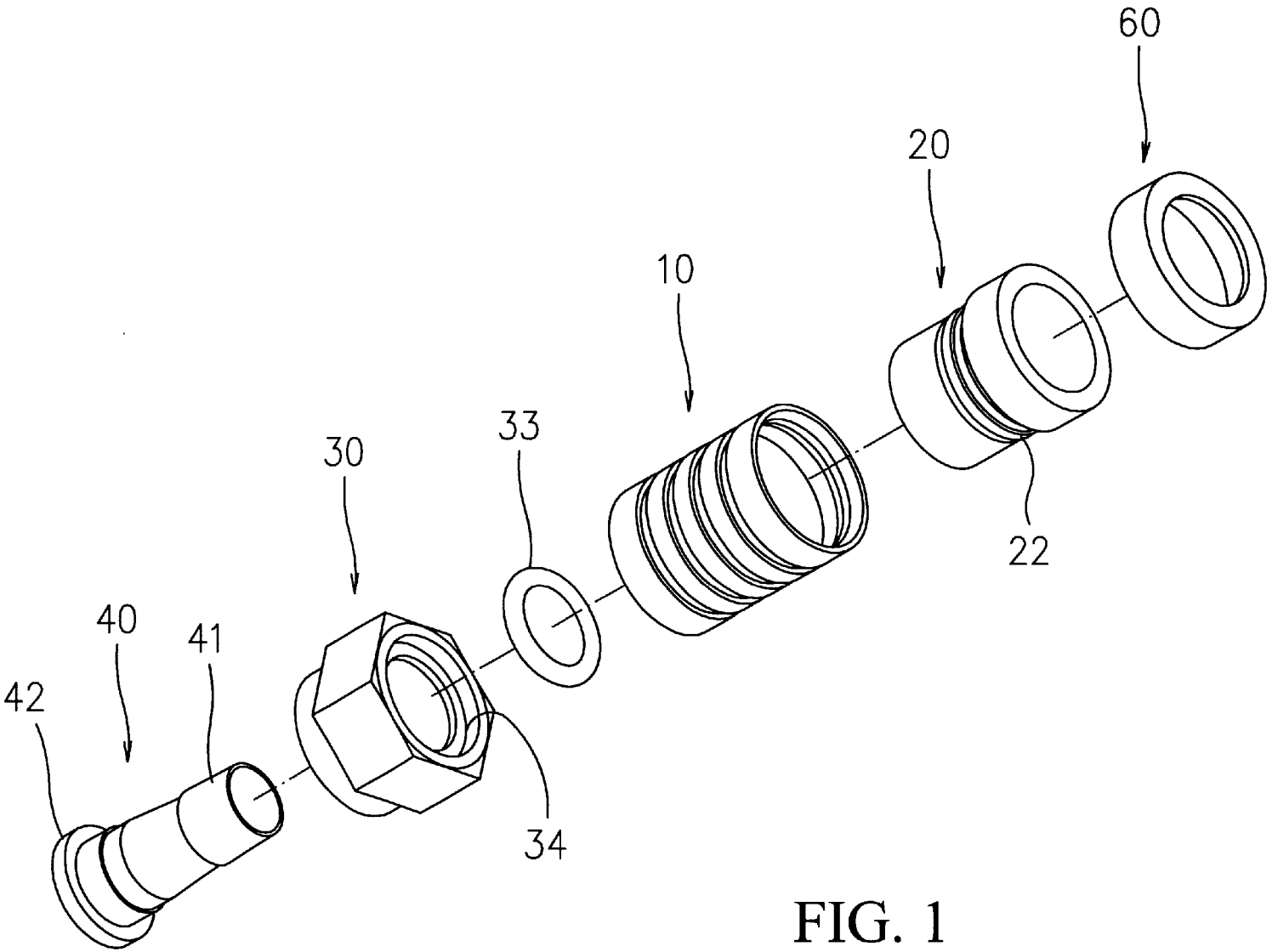
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
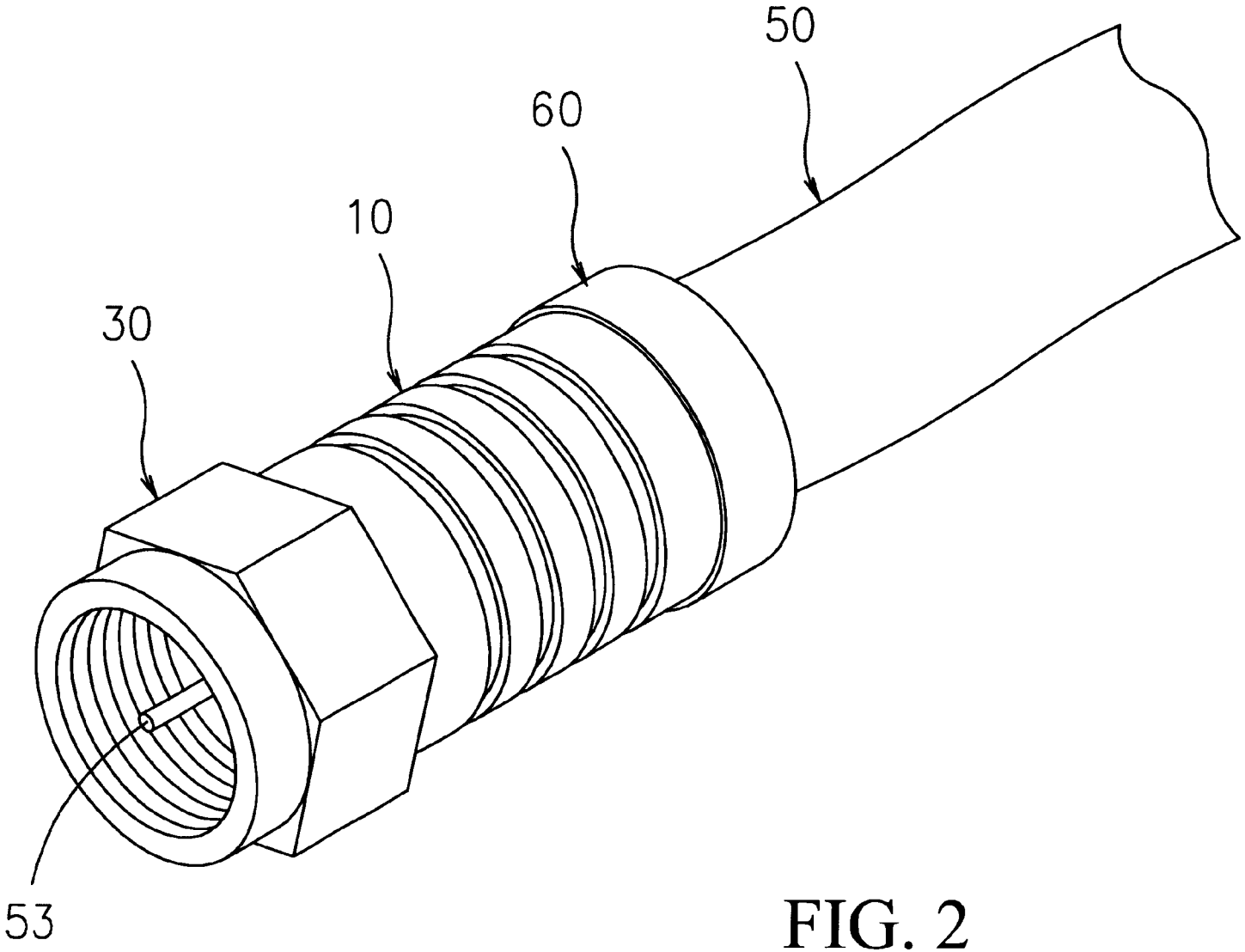
FIG. 2 is a perspective view of the present invention.

With reference to drawings and in particular to FIGS. 1 and 2 thereof, the connector for electrical cords and cables according to the present invention generally comprises a tubular body 10, a plastic engaging sleeve 20, a connecting sleeve 30, a connecting plug 40 and a metal ring 60.

Figure 3:
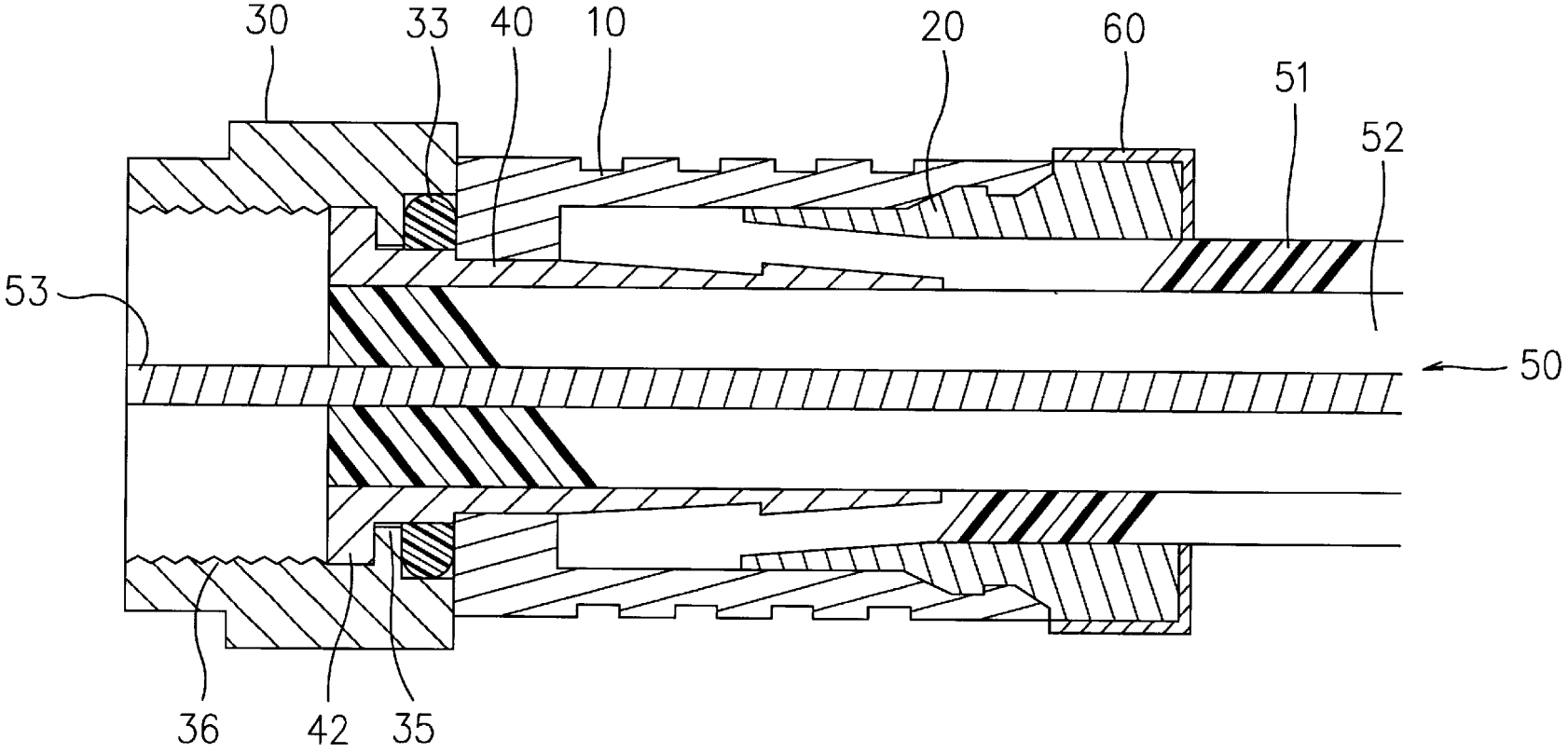
FIG. 3 is a sectional view of the present invention.
Figure 5:
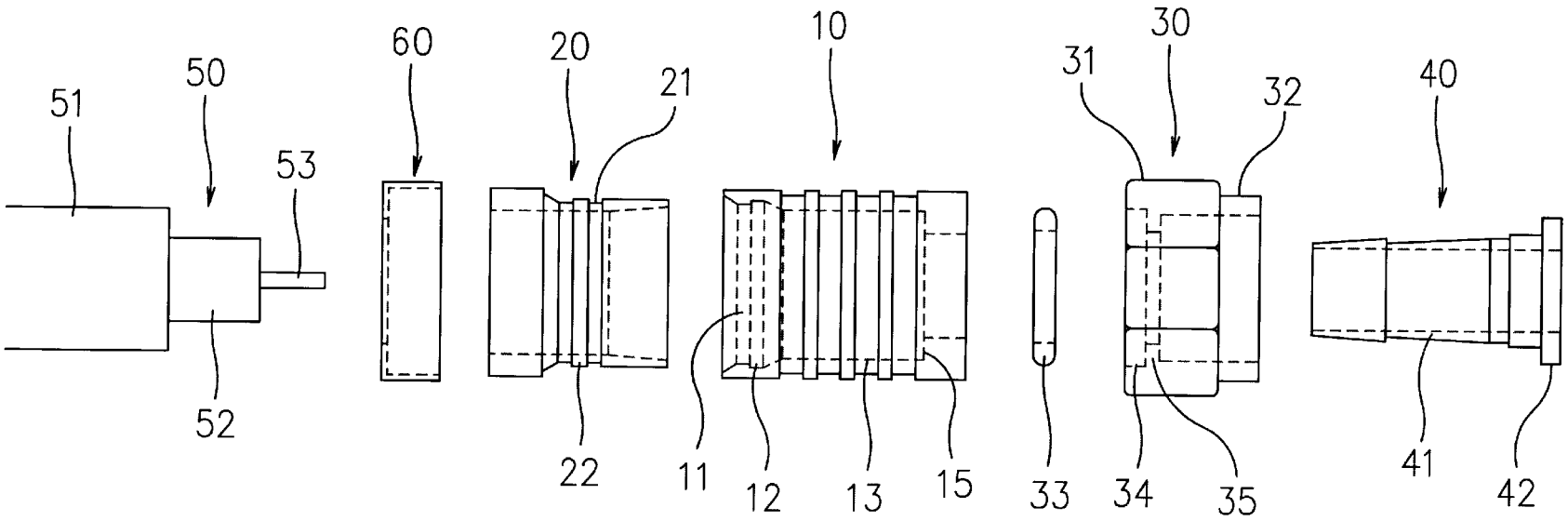
FIG. 5 is another exploded view of the present invention.

Referring to FIGS. 1, 2 and 3, the tubular body 10 has a longitudinal through hole formed with a stepped recess 11 at the left end (with respect to FIG. 5), a hole 13 at the intermediate portion, and a hole 14 at the right end (with respect to FIG. 5). The stepped recess 11 is made up of two countersunk holes 12. The hole 14 is smaller than the hole 13 thereby forming a shoulder 15 therebetween. The tubular member 10 is formed with a plurality of grooves (shown but not numbered) on its outer surface.

As shown in FIG. 5, the plastic engaging sleeve 20 has a stepped outer surface and is formed with a conical longitudinal hole with a smaller inner diameter at the larger end thereof. Furthermore, the plastic engaging sleeve 20 has a circular groove 21 at the intermediate portion and a circular projection 22 adjacent to the circular groove 21. The circular projection 22 is configured to fit snugly into the circular groove 12 of the tubular body 10.

The connecting sleeve 30 has a tubular hexagonal nut portion 31 from an end of which extends a cylindrical portion 32. The connecting sleeve 30 is formed with a through hole having a recess 34 at the outer end of the tubular hexagonal nut portion 31 for receiving an O-ring 33, a circular rib 35 adjacent to the recess 34 and internal thread extending from the circular rib 35 to the outer end of the cylindrical portion 32.

The connecting plug 40 has a longitudinal through hole for the passage of an electrical cord or cable. The outer side of the connecting plug 40 is formed with a stepped conical portion 41 at one end and a flange 42 at the other. The stepped conical portion 41 is configured to engage tightly with the tubular body 10 thereby strengthening the positioning of the electrical cord 50 or cable. As the connecting plug 40 is pushed into the connecting sleeve 30, the flange 42 of the former will bear against the circular rib 35 of the latter.

The metal ring 60 is a cap-like member having a central hole for the passage of an electrical cord or cable 50. The metal ring 60 is fitted on the larger end of the plastic engaging sleeve 20 for protecting the plastic engaging sleeve 20 from damage.

Figure 4:
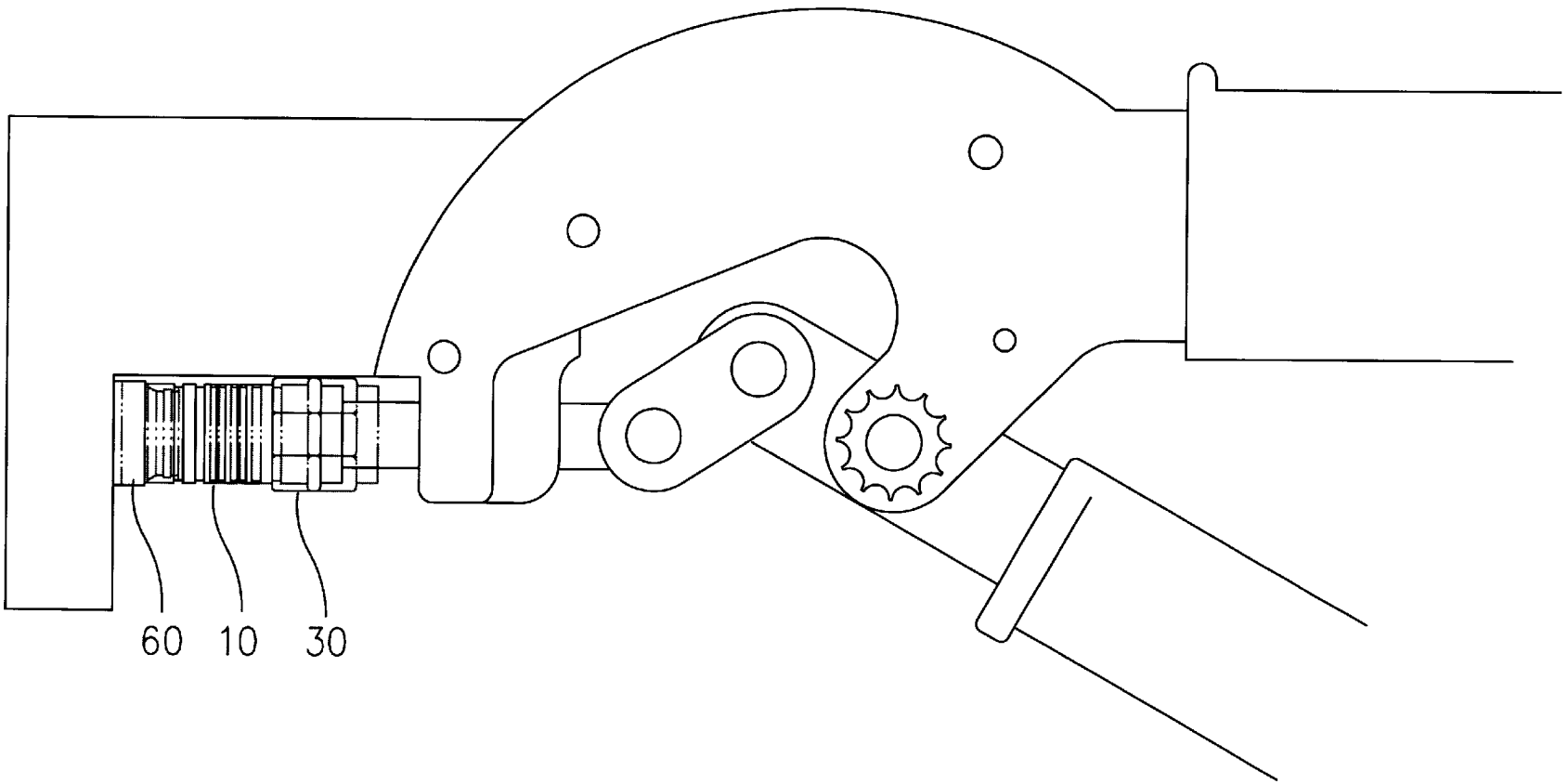
FIG. 4 illustrates how to use pliers to engage the present invention with an electrical cord or cable.

Referring to FIGS. 2, 3 and 5, the O-ring 33 is fitted in the recess 34 of the connecting sleeve 30. The cylindrical portion 32 of the connecting sleeve 30 is fitted over the connecting plug 40, with the flange 42 bearing against the circular rib 35 and the stepped conical portion 41 extending through the connecting sleeve 30 into the hole 14 of the tubular body 10. The stepped conical portion 41 of the connecting plug 40 is dimensioned so that the stepped conical portion 41 is inserted into the tubular body 10, the outer end of the stepped conical portion 41 will slightly extend out of the hole 13. The metal ring 60 is fitted on the larger end of the plastic engaging sleeve 20. Then, an end of the electrical cord (or cable) 50 is cut to form an outer layer 51, an intermediate layer 52 and a center conductor 53. The electrical cord (or cable) 50 is inserted from the larger end of the plastic engaging sleeve 20 into the stepped conical portion 41 of the connecting plug 40, so that that the center conductor 53 extends through the connecting plug 40 into the cylindrical portion 32 of the connecting sleeve 30 with the outer layer 51 of the electrical cord (or cable) 50 fitted over the stepped conical portion 41 of the connecting plug 40 and between the stepped conical portion 41 and the tubular body 10. The smaller end of the plastic engaging sleeve 20 is forced into the stepped conical hole 11 of the tubular body 10. By means of the engagement between the circular projection 22 of the plastic engaging sleeve 20 and the circular groove 12 of the tubular body 10, the outer layer 51 will be firmly kept in place thereby preventing the electrical cord (or cable) 50 from becoming loose and keeping it from water. Referring to FIG. 4, when the plastic engaging sleeve 20 is forced into the stepped conical hole 11 of the tubular body 10 by pliers or the like, the metal ring 60 will protect the plastic engaging sleeve 20 from being broken.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connector for electrical cords and cables comprising:

a tubular body having a longitudinal through hole formed with a stepped recess at an end thereof, a first hole at an intermediate portion thereof, and a second hole at another end thereof, said stepped recess being made up of two countersunk holes, said second hole being smaller than said first hole thereby forming a shoulder therebetween, said tubular member being formed with a plurality of grooves on an outer surface thereof;

a plastic engaging sleeve having a stepped outer surface and formed with a conical longitudinal hole with a smaller inner diameter at the larger end thereof, said plastic engaging sleeve having a circular groove at the intermediate portion and a circular projection adjacent to the circular groove which is configured to fit snugly into a circular groove of said tubular body;

a connecting sleeve having a tubular hexagonal nut portion from an end of which extends a cylindrical portion, said connecting sleeve being formed with a through hole having a recess at the outer end of the tubular hexagonal nut portion for receiving an O-ring, a circular rib adjacent to the recess and internal threads extending from said circular rib to an outer end of said cylindrical portion;

a connecting plug having a longitudinal rough hole for passage of an electrical cord or cable, an outer side of said connecting plug being formed with a stepped conical portion at one end and a flange at another end, said stepped conical portion being configured to engage tightly with said tubular body thereby strengthening positioning of said electrical cord or cable, said flange bearing against said circular rib when said connecting plug is pushed into said connecting sleeve; and a metal ring having a central hole for passage of an electrical cord or cable and fitted on the larger end of said plastic engaging sleeve for protecting said plastic engaging sleeve from damage.

* * * * *